US007889219B2

(12) United States Patent
Sasaki et al.

(10) Patent No.: US 7,889,219 B2
(45) Date of Patent: Feb. 15, 2011

(54) THERMAL HEAD

(75) Inventors: Tsuneyuki Sasaki, Fukushima-ken (JP); Hirotoshi Terao, Fukushima-ken (JP); Yukiko Yasuda, Fukushima-ken (JP); Tomoko Wauke, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 112 days.

(21) Appl. No.: 12/483,795

(22) Filed: Jun. 12, 2009

(65) Prior Publication Data

US 2009/0315966 A1 Dec. 24, 2009

(30) Foreign Application Priority Data

Jun. 24, 2008 (JP) ..... 2008-164313

(51) Int. Cl.
*B41J 2/335* (2006.01)
*B41J 2/345* (2006.01)

(52) U.S. Cl. ..... 347/200; 347/208

(58) Field of Classification Search ..... 347/200, 347/208

See application file for complete search history.

(56) References Cited

U.S. PATENT DOCUMENTS 6,271,873 B1 * 8/2001 Sambongi ..... 347/208
7,372,477 B2 * 5/2008 Yokoyama ..... 347/208
2007/0176974 A1 8/2007 Nakanishi et al.
2008/0100686 A1 5/2008 Nishi

FOREIGN PATENT DOCUMENTS

| | | | |
|---|---|---|---|
| JP | 3-114845 | * | 5/1991 |
| JP | 2001-162849 | | 6/2001 |
| JP | 2004-255650 | | 9/2004 |
| JP | 2005-224992 | | 8/2005 |
| JP | 2006-321093 | | 11/2006 |
| JP | 2006-335002 | | 12/2006 |
| JP | 2008-168485 | * | 7/2008 |

OTHER PUBLICATIONS

European Search Report for European Patent Application No. 09 007 690.2 dated Oct. 29, 2009; 6 pages.

* cited by examiner

*Primary Examiner*—Huan H Tran
(74) *Attorney, Agent, or Firm*—Hunton & Williams, LLP

(57) ABSTRACT

A thermal head includes a substrate; a plurality of driver ICs configured to be arranged in a main scanning direction; a heater element configured to include a heat storage layer, a heating resistor layer which is made of a plurality of pairs of effective heating portions, and an electrode layer which is patterned to supply electricity to the heating resistor layer; and a protective layer configured to cover a surface of the heater element, wherein the folded electrode is formed by adjusting an area thereof such that a heat distribution of each heating resistor becomes uniform. In such a thermal head, the number of manufacturing processes or the cost does not increase and a heat distribution becomes uniform, so that a good printing result having good a degree of gloss and image can be obtained.

16 Claims, 2 Drawing Sheets

THERMAL HEAD

CROSS REFERENCE TO RELATED APPLICATIONS

The present invention contains subject matter related to and claims priority to Japanese Patent Application No. 2008-164313 filed in the Japanese Patent Office on Jun. 24, 2008, the entire contents of which is incorporated herein by reference.

BACKGROUND OF THE DISCLOSURE

1. Technical Field

The present disclosure relates to a thermal head which is optimized to a small-sized and thin thermal printer.

2. Related Art

A thermal head mounted on a printing section of a thermal printer is provided with a substrate, a plurality of driver integrated circuits (ICs) which are disposed in the main scanning direction (longitudinal direction) on the substrate, a heater element, and a protective layer which covers the heater element.

The heater element can include a heat storage layer which is made of a glaze glass or the like and extends in the main scanning direction on the substrate; a heating resistor layer which has a plurality of pairs of effective heating portions, each pair having a defined dimension (width dimension) of the main scanning direction and a defined dimension (longitudinal dimension) of a sub-scanning direction and a plurality of connection portions, each connecting the pair of effective heating portions at an end thereof in the longitudinal direction on the heat storage layer and constitutes a heating portion, an insulating layer which covers a surface of the heating resistor layer to define a planar size of the heating portion of the heater element; and an electrode layer (electrode) of a wiring pattern which is overlaid on the insulating layer to be able to supply electricity to the heating resistor layer.

The electrode layer is provided with a folded electrode which is connected with the pair of effective heating portions and the connection portion at the end thereof in the sub-scanning direction, a separate electrode which is connected with one effective heating portion of the pair of the effective heating portions at the other end thereof in the sub-scanning direction and connected to a corresponding driver IC, and a common electrode which is connected with the other effective heating portion of the pair of the effective heating portions at the other end thereof in the sub-scanning direction. An example of the above-described conventional thermal head can be found in, for example, Japanese Unexamined Patent Application Publication No. 2006-321093.

In recent years, as a printer is required to be mounted on a portable device to be driven by batteries, and the thermal head of the printer having the above-mentioned configuration also is required to be reduced in size. Accordingly, it is essential that forming areas of the wiring patterns for electrodes through which electricity is supplied to heater elements of the thermal head are narrowed.

In addition, a heating resistance of the thermal head using a battery as a driving source has to be small in order to obtain a sufficient power at a low voltage. However, when the forming area of the wiring pattern for each electrode is narrowed and the heater elements for 128 dots are connected to one driver IC, it is difficult to adjust an oversize (width dimension and length dimension) of the wiring pattern to reduce a wiring resistance. In addition, variation in resistance value occurs among the respective heater elements. Since the variation in resistance value generates density unevenness in printing, it is likely impossible to obtain a good printing result.

As a countermeasure about these problems, a method is also considered in which the heating resistor layer constituting the respective heater elements is formed and then applied with a proper voltage pulse thereon to adjust the resistance value to be reduced as is described in, for example, Japanese Unexamined Patent Application Publication No. 2004-255650. However, such an adjustment has to be performed on the respective heads, and that is very cumbersome. In addition, since the number of the manufacturing steps of the thermal head is increased, manufacturing costs are also increased.

In addition, there is a proposal in which the size of the heating resistor constituting each heater element is changed. However, the dot sizes thereof are different from each other, and distortion occurs in the printing result. Further, energization correction (reverse correction) may be considered to be performed on the heating resistor constituting each heater element, but a correction ratio is changed according to the variation of the thermal head as a product, a printing pattern, or a printing ratio, making it difficult to perform a uniform energization correction.

In addition, the printing portion of the thermal printer heats the heater elements of the thermal head selectively by supplying electricity thereto, and necessarily presses a recording medium with a proper pressure. Therefore, in order to obtain a printing result with a good degree of gloss and image clarity (sharpness of reflection) like a picture on a surface of a recording medium, the surface of the thermal head with which the recording medium comes into contact in printing should be smooth without a step.

Here, on the surface of the protective layer which is formed as an uppermost layer of the thermal head, in particular a step is formed, which is resulted from a thickness of a resistor layer or an electrode layer which are formed on the lower layer thereof. Generally, the step of the resistor layer is formed thin to have the thickness of 0.1 to 0.2 μm, the step of the electrode layer made of aluminum (Al) or the like is formed to have the thickness of 0.7 to 1.0 μm. Therefore, in particular, the step caused by the thickness of the electrode layer much affects the quality of the printing result. Here, in order to remove the step, a working process has been generally implemented to achieve smoothing by polishing the surface of the protective layer as described in, for example, Japanese Unexamined Patent Application Publication No. 2005-224992 and Japanese Unexamined Patent Application Publication No. 2006-335002.

However, a working for removing a step of the surface of a protective film using a polishing operation may include a secondary working, which may increase the number of manhours. In addition, a load on manufacture, such as variation in the shape of the heater element after removing the step, increases.

In addition, in order to downsize a thermal head and increase a yield of the heater element, a heating resistor may be disposed on an inclined position rather than on the top portion of a heat storage layer formed in a convex shape. Moreover, in manufacturing steps, the surface of the thermal head in the wafer state may be polished in many cases. In such a case, it is very difficult to polish a folded electrode which is disposed on the deepest position (position away from the protruded top portion) in inclination of the convex heat storage layer while keeping its curvature. Therefore, a polishing process becomes easier as the dimension of the folded electrode is shorter. However, if the dimension of the folded electrode is too short, a heat distribution of the heating resistor required for printing is not accomplished. For this reason, if the folded electrode excessively accumulates heat, an ink ribbon may be affected by damage (thermal damage) when the ink ribbon is detached, which adversely affects the ink ribbon to get torn, wrinkle, or the like.

These and other drawbacks exist.

SUMMARY OF THE DISCLOSURE

An advantage of some various embodiments is to provide a high-quality thermal head, in which the number of manufacturing processes or the cost does not increase and the heat distribution becomes uniform at the time of supplying electricity without depending on adjustment of the resistance values of plural heating resistors. In these embodiments a good printing result can be obtained and, in particular, a good degree of gloss and image clarity in the printing result can be realized, and furthermore the thrifty power consumption is provided at the same time.

In order to solve the above-noted problems with conventional solutions, a thermal head according to various embodiments includes: a substrate; a plurality of driver ICs configured to be arranged in a main scanning direction on the substrate; a heater element configured to include a heat storage layer formed on the substrate, a heating resistor layer which is made of a plurality of pairs of effective heating portions formed on the heat storage layer as a heating resistor, and an electrode layer which is patterned to supply electricity to the heating resistor layer; and a protective layer configured to cover a surface of the heater element, wherein the electrode layer is provided with a folded electrode which is connected with the pair of the effective heating portions at an end thereof in a sub-scanning direction perpendicular to a main scanning direction, a separate electrode which is connected with one effective heating portion of the pair of the effective heating portions at the other end thereof in the sub-scanning direction and connected to a corresponding driver IC, and a common electrode which is connected with the other effective heating portion of the pair of the effective heating portions at the other end thereof in the sub-scanning direction, and wherein the folded electrode is formed by adjusting an area thereof such that a heat distribution of each heating resistor becomes uniform.

In such a configuration of the thermal head, the pair of effective heating portions may constitute the heating resistor, which may be connected with the folded electrode. The area of the folded electrode may be adjusted to control the heat distribution of the heating resistor of the heater element, so that a good printing result can be obtained. In addition, loss in thermal radiation to the folded electrode may be improved, so that the thrifty power consumption can be achieved.

In the thermal head according various embodiments, a wiring pattern of the separate electrode connected to each corresponding driver IC may be patterned radially such that the wiring dimension of the separate electrode disposed at the center position becomes shorter than that of the separate electrode disposed at the end side in arrangement with respect to each driver IC. Further, the folded electrode may be patterned such that an area of the folded electrode disposed at the center position becomes larger than that of the folded electrode disposed at the end side in arrangement with respect to each driver IC.

In such a configuration of the thermal head, the heat distribution of the heating resistor of the respective heater elements which are arranged in the main scanning direction of the thermal head can be substantially uniform.

Specifically, an area of the folded electrode may be adjusted by changing a length dimension thereof in the sub-scanning direction.

In addition, the length dimension of the folded electrode in the sub-scanning direction may be approximately 20 μm or more and 50 μm or less.

As such, in the thermal head in which the length dimension of the folded electrode is adjusted in the sub-scanning direction thereof, the step caused by the thickness of the electrode layer is difficult to affect the printing result. In addition, when the protective layer is polished in the manufacturing processing, a polishing process is performed easily.

In addition, the length dimension of the folded electrode in the sub-scanning direction may be approximately 30% or less of the length dimension of the heating portion of the heater element in the sub-scanning direction.

As such, in the thermal head in which the length dimension of the folded electrode is adjusted in the sub-scanning direction thereof, the heat damage given to an ink ribbon or the like is not worsened, for example.

In addition, in a range of approximately ±200 μm from the center of the heating resistor of the heater element in the sub-scanning direction, a step of the surface of the protective layer, which is generated due to a thickness of a layer laminated below the protective layer, may be formed to be approximately 0.2 μm or less.

In such a configuration of the thermal head, it is possible to obtain a good printing result of the degree of gloss and the image clarity (sharpness of reflection) on a surface of the recording medium.

In a thermal head according to various embodiments, the number of manufacturing processes or the cost does not increase and the heat distribution of the heating resistor becomes uniform at the time of supplying electricity, so that a good printing result can be obtained and in particular a good degree of gloss and image clarity in the printing result can be realized, and furthermore the thrifty power consumption is provided at the same time.

DESCRIPTION OF EXEMPLARY EMBODIMENTS

The following description is intended to convey a thorough understanding of the embodiments described by providing a number of specific embodiments and details involving thermal heads. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

Figure 1:
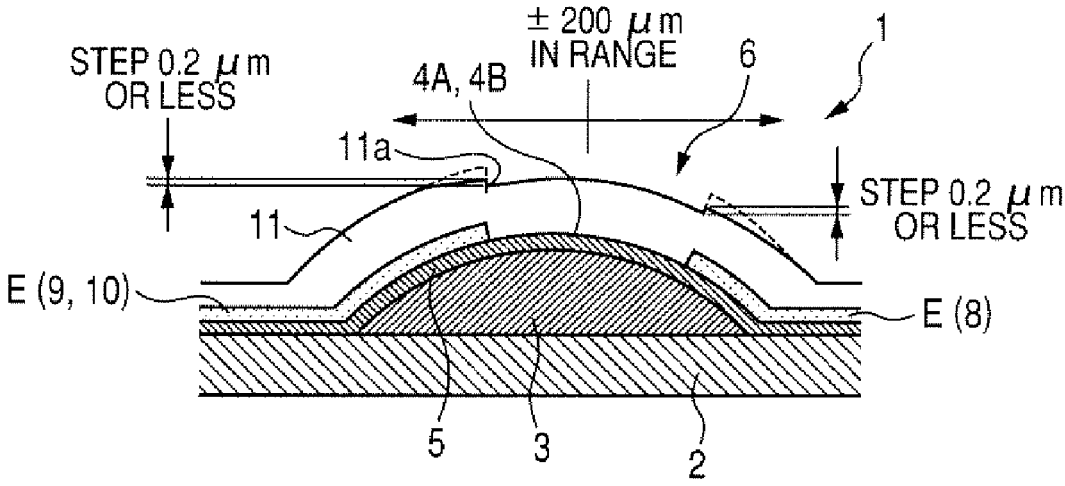
FIG. 1 is cross-sectional view schematically illustrating a thermal head according to an embodiment of the disclosure.

As shown in FIG. 1, a thermal head 1 according to an embodiment may be provided with a heat dissipation substrate 2. On the substrate 2, a plurality of driver ICs (not shown) may be disposed so as to be arranged in a main scanning direction (width direction of a recording paper) perpendicular to a recording direction. In addition, a heater element 6 may be formed on the substrate 2 and may include a heat storage layer 3 which may be formed of a heat insulating material, such as a glass, in a cylindrical shape, a heating resistor layer 5 on which a plurality of pairs of effective heating portions 4A and 4B may be formed on the heat storage layer to constitute a heating resistor 4, an insulating layer (not shown) which may cover a surface of each heating resistor layer 5 to define a planar size of the heating resistor 4, that is, a dimension (width dimension) thereof in the main scanning direction perpendicular to the recording direction and a dimension (length dimension) thereof in the sub-scanning direction as the recording direction, and an electrode layer E which is made of an aluminum material Al overlaid on the heating resistor 4 to supply electricity. In addition, an abrasion-resistance protective layer 11 may be formed so as to cover the heating resistor layer 5, the insulating layer, and the electrode layer E which constitute the heater element 6. Further, a pair of effective heating portions 4A and 4B may constitute one dot, for example.

The heat storage layer 3 may be a glaze layer which may be formed on the entire surface of the heat dissipation substrate 2 with a uniform thickness, which may extend in the main scanning direction. In addition, the insulating layer may be formed of an insulating material such as, for example, $SiO_2$, SiON, or SiAlON. The heating resistor layer 5 may be partly formed on the heat storage layer 3 using a cermet material such as, for example, $Ta_2N$ or Ta—$SiO_2$. Further, the heating resistor layer 5 may include a pair of rectangular effective heating portions 4A and 4B, each having a length dimension and a width dimension. The heating resistor 4 only may be present in a heating portion that is, it only may be present under the insulating layer. In addition, the electrode layer E may include a folded electrode 8 which may be connected with the pair of effective heating portions 4A and 4B at the end thereof in the sub-scanning direction, a separate electrode 9 which may be connected with one effective heating portion 4A of the pair of effective heating portions 4A and 4B at the other end thereof in the sub-scanning direction, and a common electrode 10 which may be connected with the other effective heating portion 4B of the pair of effective heating portions 4A and 4B at the other end thereof in the sub-scanning direction.

Figure 2:
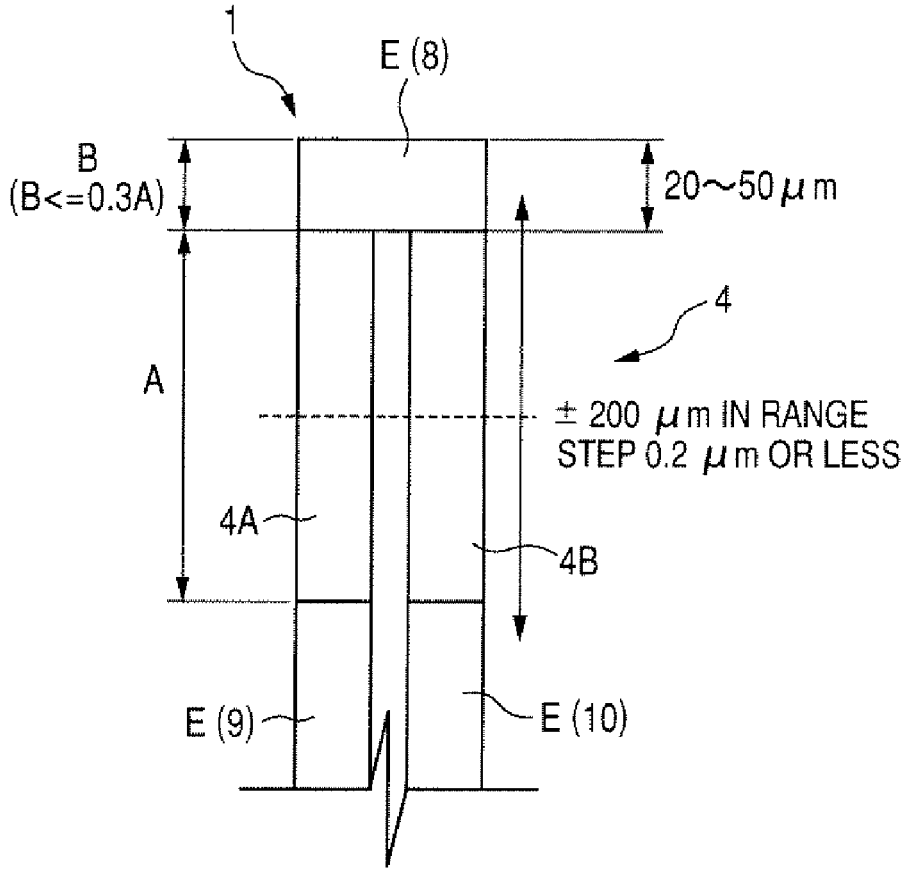
FIG. 2 is a plan view illustrating a thermal head according to an embodiment of the disclosure.

In an embodiment, the area of each folded electrode 8 may be formed to be adjusted such that the heat distribution in the heating resistor 4 is connected thereto at the time of supplying electricity. As shown in FIG. 2, the area of the folded electrode 8 may be adjusted by changing the length dimension B in the sub-scanning direction. As such, the heat distribution of the heating resistor 4 of the heater element 6 may be controlled by adjusting the area of the folded electrode 8 connected to the pair of effective heating portions 4A and 4B which may constitute the heating resistor 4, so that it may be possible to obtain a good printing result without the density unevenness even though the resistance value of the heating resistor 4 is not adjusted as in the related art.

More specifically, in various embodiments, each folded electrode 8 may be formed such that its length dimension B in the sub-scanning direction is approximately 20 μm or more and 50 μm or less, and approximately 30% or less of the length dimension A of the heating resistor 4 as the heating portion of the heater element 6 in the sub-scanning direction.

In the thermal head 1 which may have the specification of the length dimension B of the folded electrode 8 in the sub-scanning direction, the step caused by the thickness of the electrode layer may be difficult to affect the printing result. In addition, even though the protective layer may be polished in the manufacturing processing, the polishing process may be performed easily. Further, by making the length dimension to be approximately 30% or less of the heating resistor of the heater element 6 in the sub-scanning direction, an excessive heat storage in the folded electrode 8 may be suppressed, and the heat damage applying on the ink ribbon can be prevented.

In addition, the separate electrodes 9 may be electrodes for supplying electricity to the respective heating resistors 4 separately, which may be formed in a strip shape extending in the length direction of the heating resistor 4 to be connected with a plurality of driver ICs for switching between supply and non-supply of electricity to the separate electrodes 9 corresponding thereto, respectively. In various embodiments, the wiring pattern of the separate electrode 9 which is connected with each driver IC may be patterned radially (e.g., fan ribs shape) such that the wiring dimension of the separate electrode 9 disposed at the center position may become shorter than that of the separate electrode 9 disposed at the end side in arrangement with respect to each driver IC. In addition, as shown in FIG. 3, in order that the heat distribution of the heating resistors 4 of the respective heater elements 6 which are arranged in the main scanning direction of the thermal head 1 is subsequently uniform, the folded electrode 8 may be patterned such that an area of the folded electrode 8 disposed at the center position may become larger than that of the folded electrode 8 disposed at the end side in arrangement with respect to each driver IC.

In various embodiments, in order that the heat distribution is uniform at the time of supplying electricity, the area of the folded electrode 8 may be adjusted in consideration of the resistance value of the heating resistor 4 of each heater element 6 and the wiring.

Figure 3:
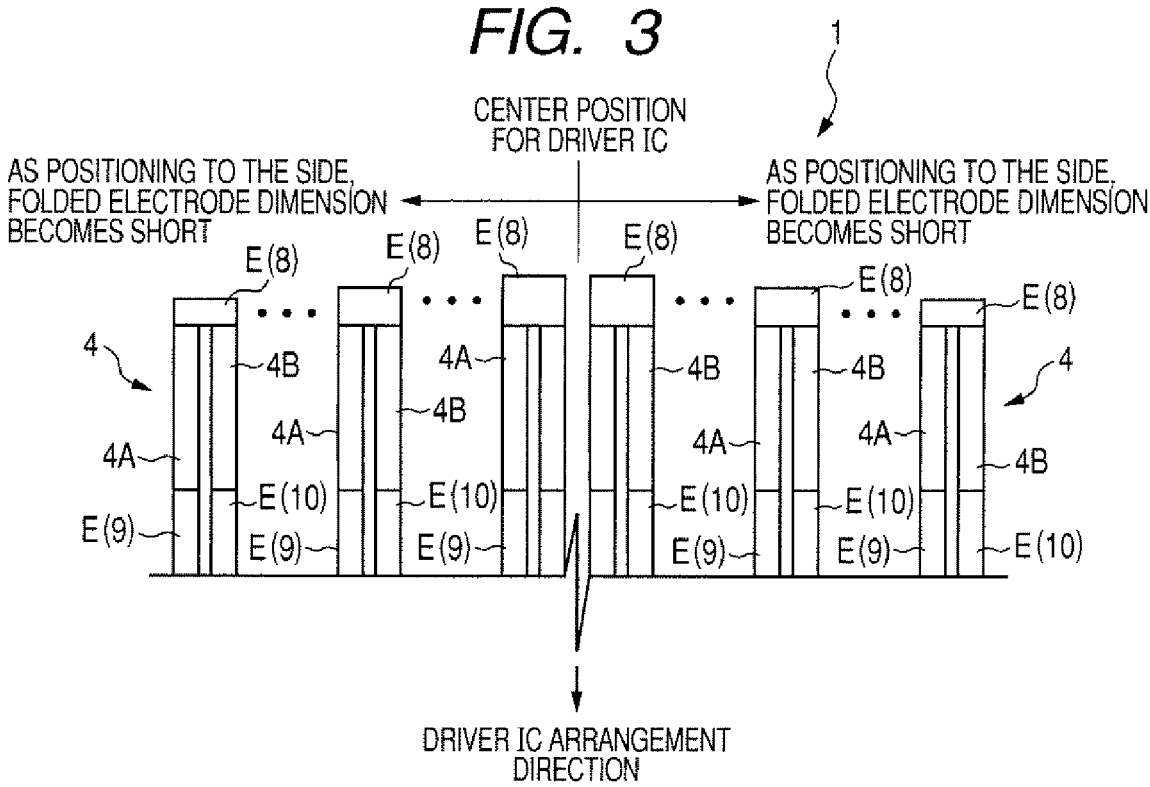
FIG. 3 is a view illustrating an example of forming folded electrodes on a thermal head according to an embodiment of the disclosure.

That is, as shown in FIG. 3, each driver IC may be positioned at the center portion of the plurality of heater elements 6 corresponding thereto in the arrangement direction, the folded electrodes 8 connected to these heater elements 6 may be formed such that the area thereof becomes smaller as away from the center portion to the side, and specifically, the length dimension in the sub-scanning direction becomes smaller.

In addition, the common electrode 10 may be an electrode to supply a common potential to the plurality of heating resistors 4. The common electrode 10 may include a line electrode portion (not shown) which may extend in a line shape in the arrangement direction of the plurality of heating resistors 4 in the edge portion on the mounting side of the driver IC of the substrate 2 and may feed the power from both ends in the arrangement direction by a power source, and a plurality of Y-shaped electrode portions which may extend in the length direction of the heating resistor 4 from the line electrode portion and may be connected to the other effective heating portion 4B of the pair of effective heating portions 4A and 4B. The separate electrode 9 and the Y-shaped electrode portion of the common electrode 10 may be formed such that the width dimension thereof is approximately equivalent to the width dimension W of the pair of effective heating portions 4A and 4B of the heating resistor 4, and each end portion of the effective heating portions 4A and 4B may be formed so as to be overlaid on the insulating layer.

The protective layer 11 may be made of an abrasion-resistance material, such as, for example, SiAlON or $Ta_2O_5$, which may protect the insulating layer and the electrode layer E (the folded electrode 8, the separate electrode 9, and the common electrode 10) on the surface of each heater element 6 against the abrasion generated at the head operation. Since the thickness of the protective layer 11 is uniform, an irregular shape of the surface of the substrate 2, that is, a step which is generated due to the thickness of the layer, in particular, the electrode layer E, formed below the protective layer 11 may be transferred on the surface of the protective layer 11. A smooth step portion 11*a* which is processed by polishing so as to be brought into contact with a printing medium may be provided over the insulating layer (in FIG. 1, a portion removed by polishing is marked with a broken line).

In various embodiments, as shown in FIG. 1, in a range of approximately ±200 μm from the center of the heating resistor 4 which may serve as a heating portion of the heater element 6 in the sub-scanning direction, the step portion 11*a* may be formed such that its dimension is approximately 0.2 μm or less. With such a dimension of the step, in printing, even though the thermal head 1 is pressed on the printing medium in a state of supplying electricity to the thermal head 1, the irregular shape may not be transferred on the surface of the printing medium. Therefore, it may be possible to obtain a good printing result of the degree of gloss and the image clarity (sharpness of reflection) on the surface of the recording medium.

Figure 4:
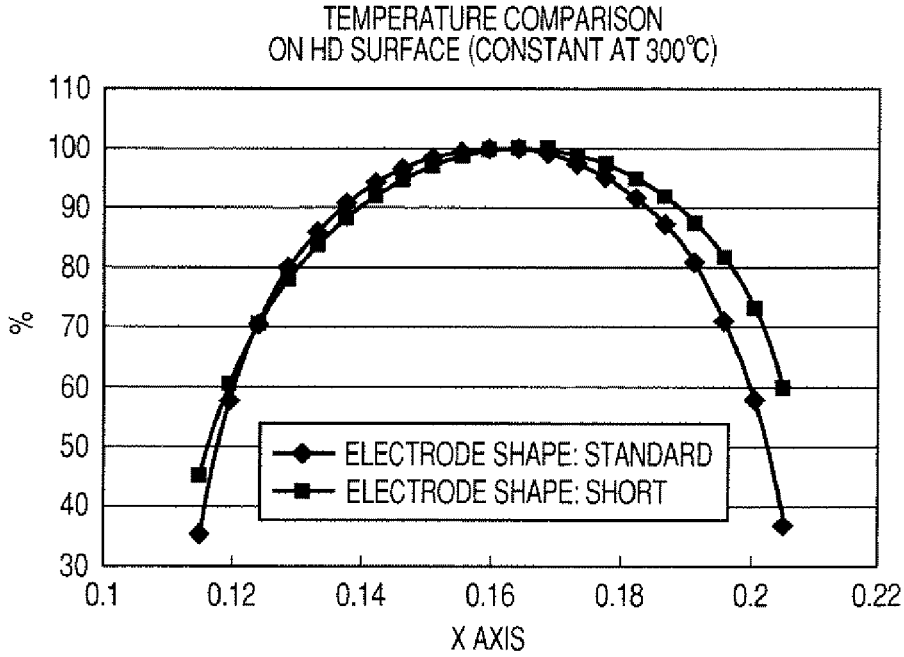
FIG. 4 is a graph illustrating results for checking an effect of thrifty power consumption in a thermal head according to an embodiment of the disclosure.

In addition, FIG. 4 is a graph illustrating the comparison of surface temperatures of the heating resistors 4 between the thermal head 1 according to various embodiments of the disclosure in which the folded electrode 8 is formed to be connected with the heating resistor 4 having the same length dimension (approximately 100 μm) and width dimension (approximately 30 μm) in accordance with the above-mentioned specification (the folded length dimension is approximately 30 μm), and the known thermal head 1 (the folded length dimension is approximately 125 μm). In the graph, the temperature (assuming that 300° C. corresponds to 100% in the vertical axis) of the center of each heating resistor 4 in the length direction is shown on the center of the X axis. The temperature of the end of the substrate on which the folded electrode 8 is formed is shown on the right side of the X axis. The temperature of the end of the substrate on which the common electrode 10 and the separate electrode 9 are formed is shown on the left side of the X axis.

As shown in the graph, the thermal head 1 according to various embodiments can improve the loss in thermal radiation to the folded electrode without changing the resistance value and the center heating temperature. That is, it can be known that a leak heat on both ends (in particular, the folded electrode 8) of the heating resistor 4 may be reduced and the heat is accumulated according to the thermal head 1 of various embodiments of the disclosure compared with the known thermal head 1. Therefore, driving at a low voltage can be realized, and the thrifty power consumption can be achieved. As described above, because the folded electrodes 8, which are formed on both ends in the arrangement direction thereof, have a higher wiring resistance when the wiring pattern of the separate electrode 9 is formed radially, the problem of the density unevenness in the printing result can be removed by reducing the area of the folded electrode 8.

In addition, upon manufacturing the thermal head 1 according to various embodiments of the disclosure, if once a pattern mask of the folded electrode 8 adjusted in its area is made, and thereafter the wiring pattern can be printed by using the pattern mask without necessarily changing. Therefore, the cost is also reduced and the thermal head can be manufactured easily.

In addition, the embodiments of the disclosure are not limited to the above-mentioned embodiments, and various changes can be made as needed.

For example, the area adjustment of the folded electrode is performed such that the heat distribution of each heating resistor may be uniform between adjacent heating resistors, but it is not limited to the case where the adjustment is performed on the basis of the resistance value of the heating resistor. For example, it is possible to adjust the area of each folded electrode on the basis of the heating temperature or the printing state.

In addition, the arrangement of the heater elements for each driver IC may not be limited to the case where the driver IC is disposed in correspondence with the center portion in the arrangement direction of the heater elements as described above. Therefore, the wiring pattern shape of the separate electrode 9 also may not be limited to the above-mentioned radial shape.

It should be understood by those skilled in the art that various modifications, combinations, sub-combinations and alternations may occur depending on design requirements and other factors insofar as they are within the scope of the appended claims of the equivalents thereof.

Accordingly, the embodiments of the present inventions are not to be limited in scope by the specific embodiments described herein. Further, although some of the embodiments of the present invention have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. A thermal head comprising:

a substrate;

a plurality of driver integrated circuits (ICs) arranged in a main scanning direction on the substrate;

a heater element including a heat storage layer formed on the substrate, a heating resistor layer made of a plurality of pairs of effective heating portions formed on the heat storage layer as a heating resistor, and an electrode layer patterned to supply electricity to the heating resistor layer; and a protective layer configured to cover a surface of the heater element, wherein the electrode layer is provided with a folded electrode which is connected with the pair of the effective heating portions at an end thereof in a sub-scanning direction perpendicular to a main scanning direction, a separate electrode which is connected with one effective heating portion of the pair of the effective heating portions at the other end thereof in the sub-scanning direction and connected to a corresponding driver IC, and a common electrode which is connected with the other effective heating portion of the pair of the effective heating portions at the other end thereof in the sub-scanning direction, and wherein the folded electrode is formed by adjusting an area thereof such that a heat distribution of each heating resistor becomes uniform.

2. The thermal head according to claim 1 wherein a wiring pattern of the separate electrode connected to each corresponding driver IC is patterned radially such that a wiring dimension of the separate electrode disposed at the center position becomes shorter than that of the separate electrode disposed at the end side in arrangement with respect to each driver IC, and wherein the folded electrode is patterned such that an area of the folded electrode disposed at the center position becomes larger than that of the folded electrode disposed at the end side in arrangement with respect to each driver IC.

3. The thermal head according to claim 1, wherein an area of the folded electrode is adjusted by changing a length dimension thereof in the sub-scanning direction.

4. The thermal head according to claim 2, wherein an area of the folded electrode is adjusted by changing a length dimension thereof in the sub-scanning direction.

5. The thermal head according to claim 3, wherein the length dimension of the folded electrode in the sub-scanning direction is within a range of 20 μm or more and 50 pm or less.

6. The thermal head according to claim 4, wherein the length dimension of the folded electrode in the sub-scanning direction is within a range of 20 μm or more and 50 μm or less.

7. The thermal head according to claim 5, wherein the length dimension of the folded electrode in the sub-scanning direction is 30% or less of the length dimension of the heating resistor of the heater element in the sub-scanning direction.

8. The thermal head according to claim 6, wherein the length dimension of the folded electrode in the sub-scanning direction is 30% or less of the length dimension of the heating resistor of the heater element in the sub-scanning direction.

9. The thermal head according to claim 1, wherein, in a range of ±200 μm from the center of the heating resistor of the heater element in the sub-scanning direction, a step of the surface of the protective layer, which is generated due to a thickness of a layer laminated below the protective layer, is formed to be 0.2 μm or less.

10. The thermal head according to claim 2, wherein, in a range of ±200 μm from the center of the heating resistor of the heater element in the sub-scanning direction, a step of the surface of the protective layer, which is generated due to a thickness of a layer laminated below the protective layer, is formed to be 0.2 μm or less.

11. The thermal head according to claim 3, wherein, in a range of ±200 μm from the center of the heating resistor of the heater element in the sub-scanning direction, a step of the surface of the protective layer, which is generated due to a thickness of a layer laminated below the protective layer, is formed to be 0.2 μm or less.

12. The thermal head according to claim 4, wherein, in a range of ±200 μm from the center of the heating resistor of the heater element in the sub-scanning direction, a step of the surface of the protective layer, which is generated due to a thickness of a layer laminated below the protective layer, is formed to be 0.2 μm or less.

13. The thermal head according to claim 5, wherein, in a range of ±200 μm from the center of the heating resistor of the heater element in the sub-scanning direction, a step of the surface of the protective layer, which is generated due to a thickness of a layer laminated below the protective layer, is formed to be 0.2 μm or less.

14. The thermal head according to claim 6, wherein, in a range of ±200 μm from the center of the heating resistor of the heater element in the sub-scanning direction, a step of the surface of the protective layer, which is generated due to a thickness of a layer laminated below the protective layer, is formed to be 0.2 μm or less.

15. The thermal head according to claim 7, wherein, in a range of ±200 μm from the center of the heating resistor of the heater element in the sub-scanning direction, a step of the surface of the protective layer, which is generated due to a thickness of a layer laminated below the protective layer, is formed to be 0.2 μm or less.

16. The thermal head according to claim 8, wherein, in a range of ±200 μm from the center of the heating resistor of the heater element in the sub-scanning direction, a step of the surface of the protective layer, which is generated due to a thickness of a layer laminated below the protective layer, is formed to be 0.2 μm or less.

* * * * *